US009360227B2

(12) United States Patent
Barker

(10) Patent No.: US 9,360,227 B2
(45) Date of Patent: Jun. 7, 2016

(54) REMOVABLE TOP FILL TANK

(71) Applicant: Helen of Troy Limited, St. Michael (BB)

(72) Inventor: Robert Alan Barker, Berlin, MA (US)

(73) Assignee: Helen of Troy Limited, St. Michael (BB)

( * ) Notice: Subject to any disclaimer, the term of this patent is extended or adjusted under 35 U.S.C. 154(b) by 119 days.

(21) Appl. No.: 14/215,129

(22) Filed: Mar. 17, 2014

(65) Prior Publication Data

US 2014/0264963 A1 Sep. 18, 2014

Related U.S. Application Data

(60) Provisional application No. 61/794,353, filed on Mar. 15, 2013.

(51) Int. Cl.

| | |
|---|---|
| ***F24F 6/02*** | (2006.01) |
| ***B01F 3/04*** | (2006.01) |
| ***F24F 6/00*** | (2006.01) |
| ***F24F 13/00*** | (2006.01) |

(52) U.S. Cl.

CPC ..... *F24F 6/00* (2013.01); *B01F 3/0407* (2013.01); *F24F 6/02* (2013.01); *F24F 13/00* (2013.01); *F24F 2006/008* (2013.01)

(58) Field of Classification Search

CPC ..... F24F 13/00; F24F 6/00; F24F 6/02; F24F 6/04; B01F 3/04; B01F 3/04007; B01F 3/0407; B01F 3/04085

USPC ..... 261/37, 38, 66, 70, 72.1

See application file for complete search history.

(56) References Cited

U.S. PATENT DOCUMENTS 8,701,701 B2 * 4/2014 Huang ..... F24F 11/001 137/398

* cited by examiner

*Primary Examiner* — Robert A Hopkins

(74) *Attorney, Agent, or Firm* — Stroock & Stroock & Lavan LLP

(57) ABSTRACT

A reservoir system for an operating unit, such as a humidifier, includes a removable water tank configured to provide the operating unit with water. The removable water tank includes a primary reservoir for holding water, with an opening in the removable water tank fluidically connecting the primary reservoir with a secondary reservoir in the operating unit. A plunger is slidably disposed in the opening and movable between an open position in which the opening fluidically connects the primary reservoir to the secondary reservoir, and a closed position that seals the opening to fluidically disconnect the primary reservoir from the secondary reservoir. A float member in the secondary reservoir includes a buoyant main body and is configured to generate a force upon the plunger to urge the plunger into the open position according to the height of water in the secondary reservoir.

17 Claims, 5 Drawing Sheets

REMOVABLE TOP FILL TANK

CROSS-REFERENCE TO RELATED APPLICATIONS

This application claims the benefit of U.S. Provisional Application No. 61/794,353, filed Mar. 15, 2013, the contents of which are incorporated herein by reference.

BACKGROUND OF THE INVENTION

1. Field of the Invention

Various embodiments of the invention relate to a removable top fill water tank for use in association with an operating unit, and in particular for use in a humidifier.

2. Description of the Related Art

Portable humidifiers provide an economical appliance for improving indoor environmental conditions. Small humidifiers are convenient because they can be easily moved or stored. Such convenience is especially pertinent to locations with changing climates. Humidifiers can be used when the air is dry and stored away when the air is humid.

Typical portable humidifiers are designed to operate most efficiently with a specific amount of water. For example, wick-type humidifiers have a certain water level that is optimal for operation of the humidifier. Wick-type humidifiers typically include a wick and a fan. The wick sits in a pool of water held in a tray and the water is absorbed by the wick. Thus, if the water level is too low, the air blows through less of the dampened wick, resulting in less water output. On the other hand, if the water level is too high, the air is not able to blow over enough of the wick to capture a significant amount of water.

As the humidifier operates, the water level decreases. In order to keep the water at the optimum level, a water tank is utilized. The water tank continuously feeds water to the humidifier to maintain an optimal water level. The water tank also enables the humidifier to operate over extended periods of time by replenishing the water in the tray of the humidifier.

A typical humidifier water tank is a sealed container with an outlet valve in the bottom. The outlet valve is usually spring-loaded and opens upon placement of the tank onto the tray. When the tank is first placed over the empty water tray of the humidifier the water flows down into the tray. As the water leaves the tank, the pressure at the top of the sealed tank decreases. The pressure continues to decrease as water leaves the tank until the pressure is low enough to hold the water in the tank. Air is then sucked into the tank restoring the pressure and allowing the water to flow out again. This process continues with water flowing out of the tank in cycles while the tray is filled. Once the water level in the tray reaches its maximum height, it covers the outlet of the water tank. Consequently, air is prevented from being sucked into the tank because the air path to the tank outlet is blocked by the water in the tray. This keeps the pressure in the water tank low and stops the water from flowing out. The water flow does not resume until the water level in the tank has fallen to a point that allows air to be sucked into the tank in order to restore the pressure therein.

Humidifier water tanks include openings so that they can be refilled. The opening has a cap such that it can be opened and closed. Typically, the opening and its cap are provided in the bottom of the tank. In some cases, the outlet valve is integrated in the cap of the opening. Having the tank opening in the bottom of the tank requires the user to remove the water tank from the humidifier and flip it over before pouring more water into the tank. Many users find this to be a nuisance, especially when refilling repeatedly in a short period of time or when the tank is large. However, such tanks are intended to be operated this way. If the opening were provided in the top of the tank, the user would still be required to remove the tank before refilling it. Removing the tank closes the spring-loaded outlet valve, and the cap can then be removed and the tank refilled. However, at some point the user would undoubtedly attempt to fill the tank while it was placed on the tray. As soon as the user opened the cap enough to allow air to pass into the tank, the tank would effectively become a hose, with an opening in the top, and an opening in the bottom at the spring-loaded outlet valve. The water would continuously flow out of the tank, overflow the tray and making a mess. That is, by removing the cap the low back-pressure in the tank is destroyed and thus cannot hold the water back within the tank. Nonetheless, many users find water tanks with openings in their bottoms to be a nuisance.

There is thus a need for a removable tank which can be filled from the top either while remaining on the operating unit, e.g., a humidifier, or after being removed from the operating unit.

SUMMARY OF THE INVENTION

In a preferred embodiment a reservoir system for an operating unit, such as a humidifier, is provided. The reservoir system includes a removable water tank configured to operationally engage with the operating unit so as to provide the operating unit with water. The removable water tank includes a primary reservoir for holding water, an opening in the removable water tank to fluidically connect the primary reservoir in the removable water tank with a secondary reservoir in the operating unit, a plunger slidably disposed with respect to the opening. The plunger is movable between an open position in which the opening fluidically connects the primary reservoir to the secondary reservoir, and a closed position that seals the opening to fluidically disconnect the primary reservoir from the secondary reservoir. A float member in the secondary reservoir includes a buoyant main body and is configured to generate a force upon the plunger to urge the plunger into the open position according to the height of water in the secondary reservoir.

In specific embodiments the float member includes a lever coupled to the buoyant main body and an engaging member that pivotably secures the float member within the secondary reservoir. A torque is generated by the buoyant main body with respect to the engaging member to provide a corresponding torque to the lever, and the lever is configured to mechanically contact the plunger, thereby urging the plunger into the open position as a function of water level in the secondary reservoir. In such embodiments the plunger may include an elongated portion that passes through the opening, with a first enlarged portion at one end of the elongated portion for plugging the opening and a second enlarged portion at another end of the elongated portion for contacting the lever. In a particular embodiment the second enlarged portion has a substantially planar surface for contacting the lever, and the lever has a rounded surface for contacting this planar surface.

In certain embodiments the engaging member is pivotably connected to a wall that extends from the removable tank below the primary reservoir. In yet other embodiments the plunger includes an elastic element that biases the plunger into the closed position.

BRIEF DESCRIPTION OF THE DRAWINGS

The various aspects and embodiments disclosed herein will be better understood when read in conjunction with the appended drawings, wherein like reference numerals refer to like components. For the purposes of illustrating aspects of the present application, there are shown in the drawings certain preferred embodiments. It should be understood, however, that the application is not limited to the precise arrangement, structures, features, embodiments, aspects, and devices shown, and the arrangements, structures, features, embodiments, aspects and devices shown may be used singularly or in combination with other arrangements, structures, features, embodiments, aspects and devices. The drawings are not necessarily drawn to scale and are not in any way intended to limit the scope of this invention, but are merely presented to clarify illustrated embodiments of the invention. In these drawings.

DETAILED DESCRIPTION OF THE PREFERRED EMBODIMENTS

Various embodiments provide a removable water tank which can be filled from the top of the tank without fear of causing overflow in the base operating unit to which the tank feeds water. The tank can be filled either when the tank is positioned on the associated operating unit, e.g., a humidifier, or after the tank has been removed from the operating unit. This offers added convenience for a user servicing the operating unit.

Figure 1:
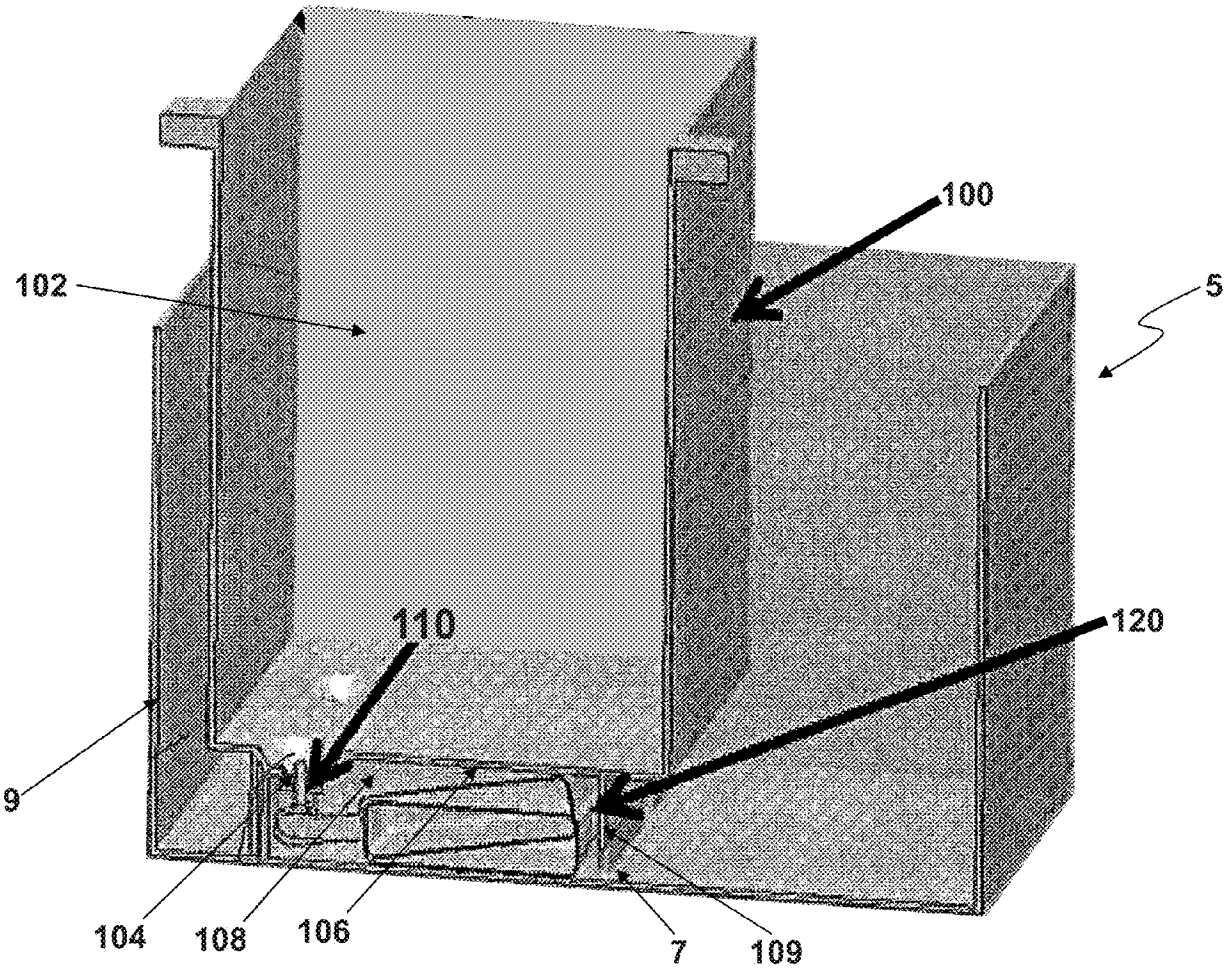
FIG. 1 is cross-sectional perspective view of an embodiment water tank disposed on an associated operating unit.

FIG. 1 illustrates an embodiment water tank 100 functionally engaged with an associated operating unit 5, such as a humidifier. Water tank 100 provides a removable top fill tank and includes an upper chamber 102 that serves as a primary water reservoir for the operating unit 5, an opening 104 at a bottom 106 of the upper chamber 102, and a plunger 110 coupled to the opening 104 via an elastic element 112. The tank 100 can further include a bottom section 108 configured to allow the tank 100 to be securely positioned within the operating unit 5. For example, the bottom section 108 of the tank 100 can include side walls 109 to engage retaining weirs 7 located at the bottom of the main housing 9 of the operating unit 5. Additionally or alternatively, when the tank 100 is assembled to the operating unit 5, the bottom side 106 of the upper chamber 102 can engage the structure of the main housing 9 of the operating unit 5, and a gap is provided between the side walls 109 of the bottom section 108 of the tank 100 and the bottom of the operating unit 5 so that water can flow out the tank 100. In the specific embodiment depicted in FIG. 1, the bottom section 108 provides or forms a portion of a secondary reservoir that is used by the operating unit 5 for its intended operations, such as to moisten a wick or the like, and water flows from the primary reservoir 102 into this secondary reservoir 108 via the opening 104. When assembled, water freely can flow from the bottom section 108 of the tank 100 to active elements in the main housing 9 of the operating unit 5, such as a wick, a heating element, an ultrasonic atomizer or the like. Other configurations of the bottom section 108 of the tank 100 can also accomplish the same effect, e.g., by including through holes on the side walls 109 of the bottom section 108. Also, the structure at the bottom of the operating unit 5 can include one or more openings to allow water to freely flow between the bottom section 108 of the tank 100 and the main housing 9 of the operating unit 5.

Figure 2:
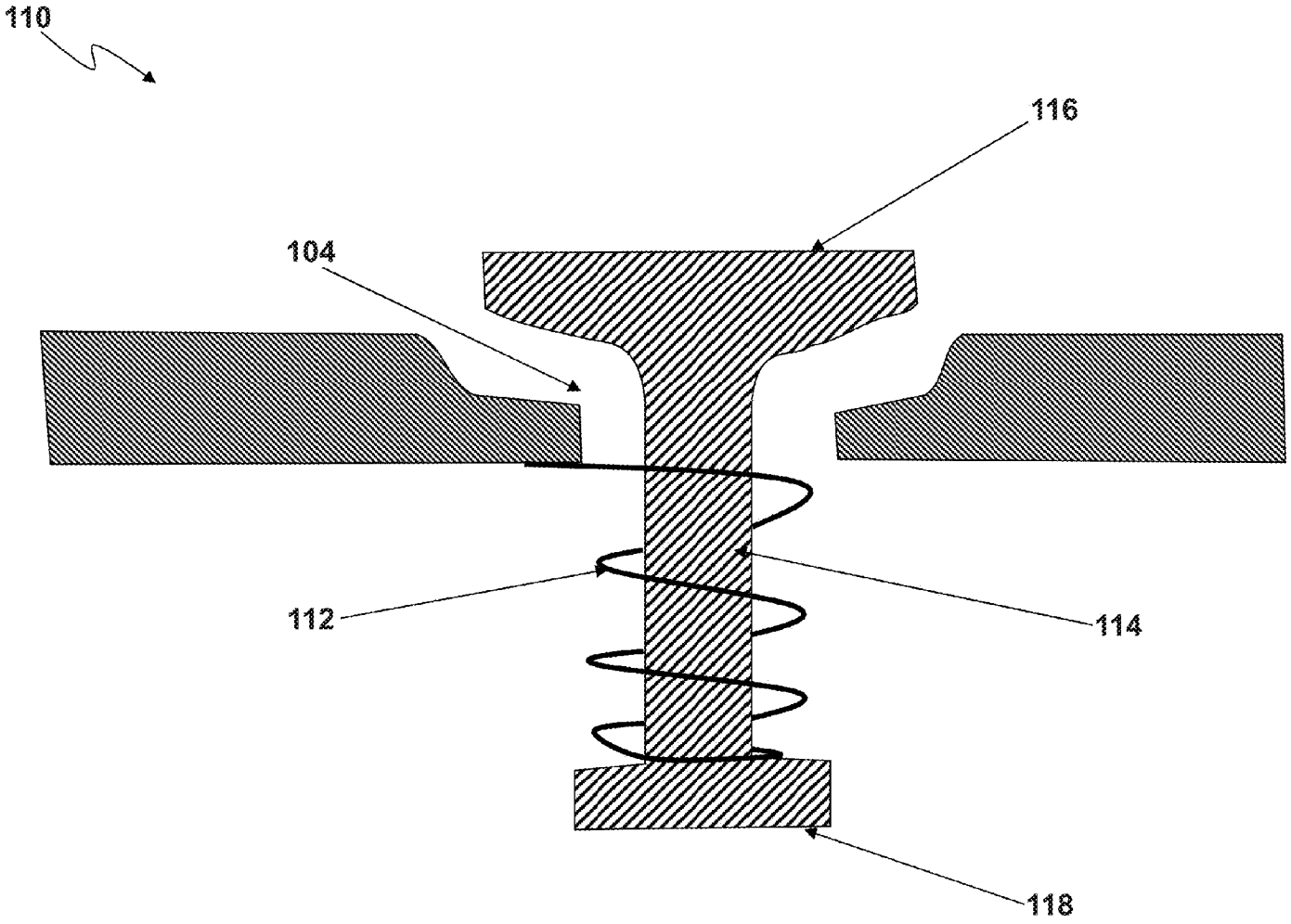
FIG. 2 is a detailed cross-sectional view of a plunger shown in FIG. 1.

The plunger 110 is shown in FIG. 2 and includes an elongated portion 114 having a cross-section that is smaller than the cross-sectional diameter of the opening 104. The elongated portion 114 moves up and down through the opening 104 while permitting water to flow between the upper chamber 102 and the bottom section 108. The plunger 110 further includes a first enlarged portion 116 disposed at an upper end of the elongated portion 114. The first enlarged portion 116 has a cross-sectional dimension that is larger than the elongated portion 114, e.g., a cross-section sufficiently large to block the opening 104 (and thus the water flow) when the plunger 110 is fitted into and mechanically engages with and seals against the opening 104. The plunger 110 may further include a second enlarged portion 118 disposed at the lower end of the elongated portion 114, which is configured, for example, as a flat disk as shown in FIG. 2, although other suitable shapes are certainly possible, such as a generally spherical shape. The elongated portion 114 has a length sufficient to traverse the opening 104, such that in operation the second enlarged portion 118 is disposed within the bottom section 108 of the tank 100 (i.e., below the opening 104).

Figure 3:
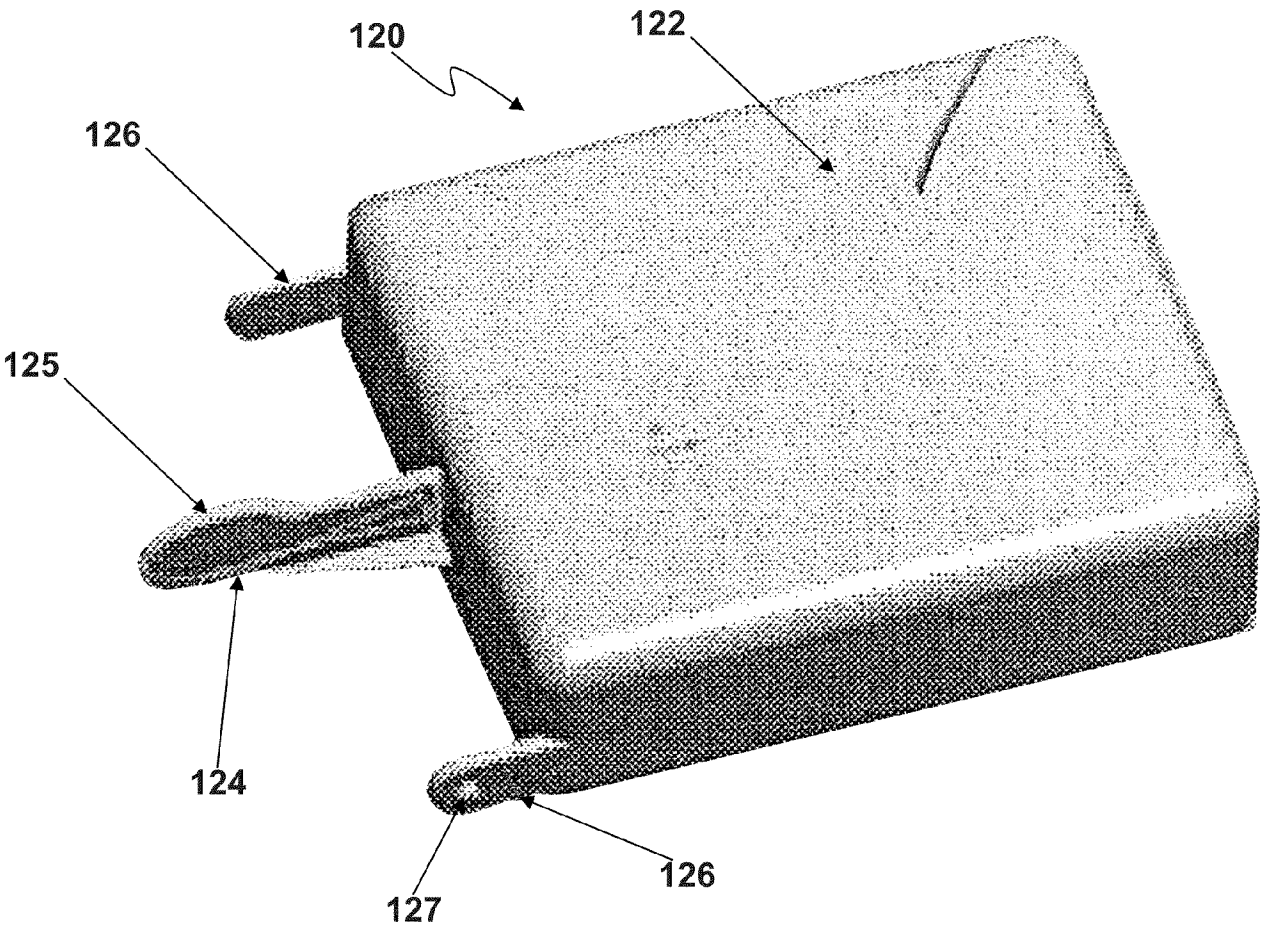
FIG. 3 is a detailed perspective view of a float member shown in FIG. 1.

As shown in FIGS. 1 and 3, the tank 100 further includes a float member 120 disposed under the bottom 106 of tank 100 and within the secondary reservoir used by the operating unit 5, such as within the bottom section 108. The float member 120 includes a main body 122 and a lever 124 extending from the main body 122. The float member 120 is retained in the bottom section 108 by any suitable pivoting mechanism. As illustrated in FIG. 3, the float member 120 can include two engaging members 126 that extend in a substantially parallel manner from opposite sides of the main body 122. The engaging members 126 rotatably engage the side walls of the bottom section 108 of the tank 100 (or a similar structure provided by the operating unit 5). By way of example, the engaging members 126 can include small outward protrusions 127 to engage with corresponding depressions on the two opposing side walls of the bottom section 108 of the tank 100. The two contacting points 127 between the engaging members 126 and the side walls define a pivotal axis about which the float member 120 can rotate. Thus, a top surface 125 of the lever member 124 can exert an upward pushing force on the plunger 110 via the second enlarged surface 118 through a torque generated by the main body 122. The magnitude of the pushing force can depend on the weight or weight distribution of the main body 122 and the distance from the center of gravity of the main body 122 to the pivoting axis 127, as well as the weight or weight distribution of the lever member 124 and the distance from the top surface 125 of the lever member 124 to the pivoting axis 127.

The float member 120, or at least the main body 122 of the float member 120, can float in water. For example, the float member 120 can be made of a material having a density which is less than that of water, such as plastic, wood, etc. Additionally or alternatively, the float member 120 can be made with a hollow interior, a foamed structure, etc., such that its overall density is less than that of water.

Figure 4:
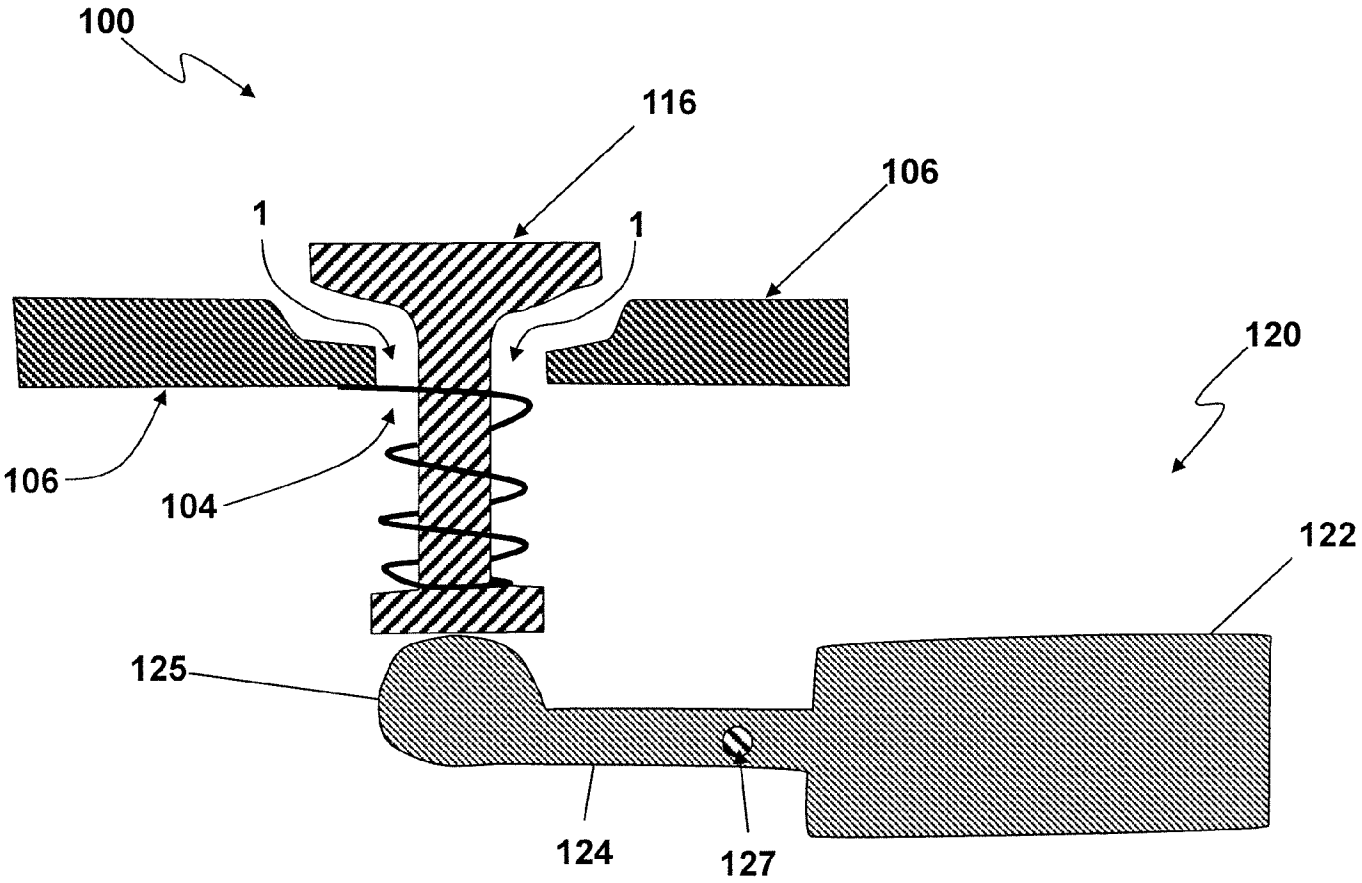
FIG. 4 is a detailed cross-sectional view of the float member and plunger shown in FIG. 1 while in an open position.
Figure 5:
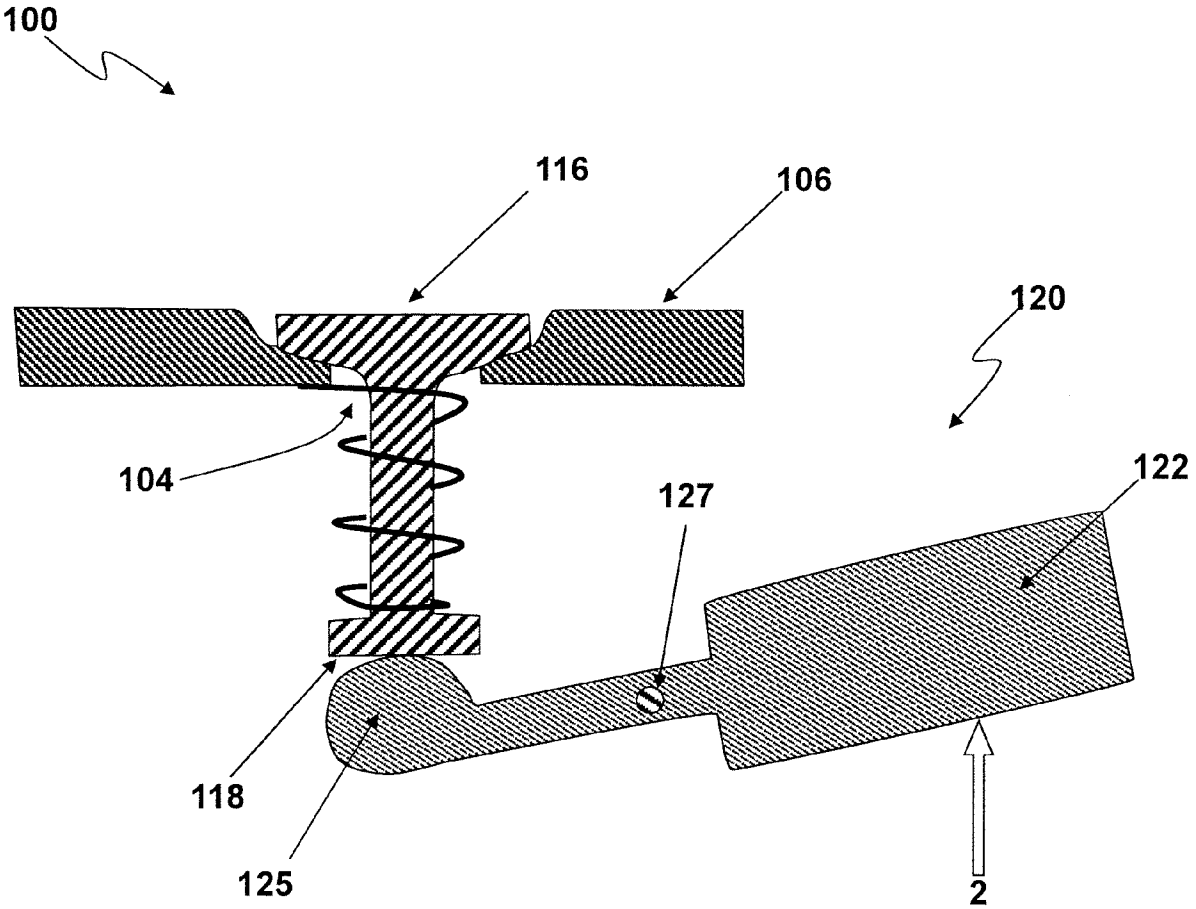
FIG. 5 is a detailed cross-sectional view of the float member and plunger shown in FIG. 1 while in a closed position.

The operation of the removable tank is explained as follows in connection with FIGS. 4 and 5. When the tank 100 is removed from the operating unit 5, e.g., to fill tank 100 with water, the plunger 110 is in a down, sealed or closed position where the first enlarged portion 116 of the plunger 110 seals the opening 104. This can be accomplished by selecting an appropriate spring force or bias for the elastic element 112 to pull the first enlarged portion 116 of the plunger 110 down onto the mouth of the opening 104 and thus fluidly sealing the opening 104; alternatively, the gravitational weight of the plunger 110 may be sufficient to provide such a sealing force. On the other hand, when the tank 100 is filled and functionally engaged with the operating unit 5, the second enlarged portion 118 of the plunger 110 is positioned above and contacts the tip 125 of the lever member 124 of the float member 120. Due to the upward pushing force applied on the plunger 110 by the tip 125 of the lever member 124, the plunger 110 is urged upward, thereby unsealing or opening the opening 104 and allowing water 1 from the tank 100 to flow into the bottom section 108 of the tank and thus into the operating unit 5. That is, the torque generated by the weight of main body 122 with respect to the pivoting axis 127 is applied to the second enlarged portion 118 via the lever member 124, and this torque exceeds the sealing force provided by the elastic member 112, the weight of the plunger 110 or both, thus forcing the plunger 110 into an open state with respect to opening 104.

When water 1 enters the bottom section 108 of the tank 100 and at least partially immerses the float member 120, an upward buoyancy force 2 is applied on the main body 122 of float member 120. The upward buoyancy force 2 can be tuned by adjusting the size, material, shape or structure of the float member 120. As the float member 120 is not freely floating but rotatably fixed at the pivot points 127, the buoyancy force 2 applied on the main body 122 causes a reduction of the upward pushing force (or torque) exerted by the tip 125 of the lever member 124 on the plunger 110. When a sufficient amount of water 1 enters the bottom section 108 of the tank 100, e.g., when a desired working water level height inside secondary reservoir of the operating unit 5 is reached, the main body 122 of the float member 120 tilts up to a sufficient degree so as to cause the plunger 110 to return back to the sealed position under the urging of spring 112, the gravitational weight of plunger 110 or both. Thereafter, when the water level decreases in the secondary reservoir 108 (due to the usage of water in the operating unit 5), the buoyancy force 2 on the float member 120 (and in particular the main body 122) causes the main body 122 to similarly go down, pivoting about the axis 127, causing an increase in the upward pushing force (or torque) on the plunger 110. When the water level decreases to a sufficiently low level, the plunger 110 will again be pushed into an open position by the upward pushing force, allowing water 1 (if any) remaining in the tank 100 to flow down through the opening 104. The above cycle can repeat until the water is depleted in the tank 100.

When filling the tank 100 with water 1 without taking the tank 100 out of the operating unit 5, the plunger 110 will initially be in the open position, and the water 1 being filled into tank 100 can enter the bottom section 108 of the tank 100 directly. When the water 1 in the operating unit 5 reaches a sufficient level, the plunger 110 returns to the closed position, sealing the opening 104, as explained above.

To facilitate effective transmission of the pushing force from the lever member 124 to the plunger 110, the lever member 124 of the float member 120 can include a rounded tip 125 to engage the second enlarged portion 118 of the plunger 110. For example, if the second enlarged portion 118 of the plunger 110 has a flat disk configuration, as shown in FIGS. 4 and 5, the rounded tip 125 of the lever member 124 can be shaped as a generally spherical bump protruding upwards from the lever member 124. In this manner, the tip 125 of the lever member 124 can have continuous and smooth contact with the plunger 110 when the lever member 124 tilts at different angles under the torque provided by the main body 122. Meanwhile, due to the point-like contact between the rounded contact surface 125 and the second enlarged portion 118, the upward pushing force generated by this torque at the different tilting angles can remain approximately vertical, that is, substantially parallel to the longitudinal length of the elongated portion 114 of plunger 110.

Although the illustrated embodiments of the tank 100 include a bottom section 108, it will be appreciated that such a bottom section 108 can be alternatively formed, partially or fully, by structures within the operating unit 5 itself. Additionally, the float member 120 can be pivotably installed on a suitable structure of the operating unit 5 instead of the bottom section 108 of the tank 100, with the lever member 124 aligned with the plunger 110 of the tank 100 when the tank 100 is engaged with the operating unit 5. Other variations and modifications of the structure of the removable tank 100 described herein are also apparent to those skilled in the art, and therefore are encompassed within the scope and spirits of the present invention.

Those skilled in the art will recognize that the present invention has many applications, may be implemented in various manners and, as such is not to be limited by the foregoing embodiments and examples. Any number of the features of the different embodiments described herein may be combined into a single embodiment, the locations of particular elements can be altered and alternate embodiments having fewer than or more than all of the features herein described are possible. Functionality may also be, in whole or in part, distributed among multiple components, in manners now known or to become known.

It will be further appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention. While there has been shown and described fundamental features of the invention as applied to being exemplary embodiments thereof, it will be understood that omissions and substitutions and changes in the form and details of the disclosed invention may be made by those skilled in the art without departing from the spirit of the invention. Moreover, the scope of the present invention covers conventionally known, future developed variations and modifications to the components described herein as would be understood by those skilled in the art.

What is claimed is:

1. A removable tank for an operating unit, the removable tank comprising:

a reservoir for holding water;

an opening in the removable water tank configured to allow water to exit from the reservoir;

a plunger at least partially movably disposed in the opening, the plunger movable between an open position in which water exits the reservoir and a closed position that seals the opening to prevent water from exiting the reservoir; and a float member movably coupled to the removable tank, the float member comprising:

a buoyant main body configured to generate a force upon the plunger to urge the plunger toward the open position based upon movement of the buoyant main body, a lever coupled to the buoyant main body, and an engaging member connected to and positioned in between the lever and at least a portion of the buoyant main body, the engaging member pivotably securing the float member to a bottom portion of the removable tank, said force generated by the buoyant main body providing a corresponding force to the lever via the engaging member, and the lever being movable to mechanically contact the plunger.

2. The removable tank of claim 1 wherein the plunger comprises an elongated portion passing through the opening, a first enlarged portion provided at a first end of the elongated portion for sealing the opening and a second enlarged portion provided at a second opposite end of the elongated portion for contacting the lever.

3. The removable tank of claim 2 wherein movement of the buoyant main body causes corresponding movement of the lever, and the corresponding movement of the lever causes the plunger to move into the closed position to seal the opening.

4. The removable tank of claim 2 wherein the second enlarged portion has a substantially planar surface for contacting the lever, and the lever has a rounded surface for contacting the planar surface of the second enlarged portion.

5. The removable tank of claim 1 wherein the engaging member is pivotably connected to a projecting surface extending downward from the removable tank, the projecting surface being below the reservoir.

6. The removable tank of claim 1 wherein the plunger further comprises an elastic element configured to bias the plunger into the closed position.

7. The removable tank of claim 6 wherein the elastic element includes a spring.

8. A reservoir system for an operating unit, the reservoir system comprising:

a removable water tank configured to operationally engage with the operating unit, the removable water tank including:

a primary reservoir for holding water;

an opening in the removable water tank configured to fluidically connect the primary reservoir in the removable water tank with a secondary reservoir in the operating unit; and a plunger at least partially movably disposed in the opening, the plunger movable between an open position in which the opening fluidically connects the primary reservoir to the secondary reservoir and a closed position that seals the opening to fluidically disconnect the primary reservoir from the secondary reservoir; and a float member at least partially disposed in the secondary reservoir, the float member comprising:

a buoyant main body configured to generate a force upon the plunger to urge the plunger toward the open position according to a height of water in the secondary reservoir, a lever coupled to the buoyant main body, and an engaging member connected to and in between the lever and at least a portion of the buoyant main body, the engaging member pivotably securing the float member within the secondary reservoir, a force generated by the buoyant main body providing a corresponding force to the lever via the engaging member, and the lever being movable to mechanically contact the plunger.

9. The reservoir system for an operating unit according to claim 8 wherein the plunger comprises an elongated portion passing through the opening, a first enlarged portion provided at a first end of the elongated portion for sealing the opening and a second enlarged portion provided at a second end of elongated portion for contacting the lever.

10. The reservoir system for an operating unit according to claim 9 wherein the second enlarged portion has a substantially planar surface for contacting the lever, and the lever has a rounded surface for contacting the planar surface of the second enlarged portion.

11. The reservoir system for an operating unit according to claim 8 wherein the engaging member is pivotably connected to a wall disposed in or forming the secondary reservoir.

12. The reservoir system for an operating unit according to claim 8 wherein the plunger further comprises an elastic element configured to bias the plunger into the closed position.

13. The reservoir system for an operating unit according to claim 12 wherein the elastic element includes a spring.

14. A humidifier comprising:

a removable water tank configured to operationally engage with a base operating unit of the humidifier, the removable water tank including:

a primary reservoir for holding water;

an opening in the removable water tank configured to fluidically connect the primary reservoir in the removable water tank with a secondary reservoir in the base operating unit; and a plunger at least partially movably disposed in the opening, the plunger movable between an open position in which the opening fluidically connects the primary reservoir to the secondary reservoir and a closed position that seals the opening to fluidically disconnect the primary reservoir from the secondary reservoir; and a float member at least partially disposed in the secondary reservoir, the float member comprising:

a buoyant main body configured to generate a force upon the plunger to urge the plunger toward the open position according to a height of water in the secondary reservoir, a lever coupled to the buoyant main body, and an engaging member connected to and in between the lever and at least a portion of the buoyant main body, the engaging member pivotably securing the float member within the secondary reservoir, a force generated by the buoyant main body providing a corresponding force to the lever via the engaging member, and the lever being movable to mechanically contact the plunger.

15. The humidifier according to claim 14 wherein the plunger comprises an elongated portion passing through the opening, a first enlarged portion provided at a first end of the elongated portion for sealing the opening and a second enlarged portion provided at a second end of elongated portion for contacting the lever.

16. The humidifier according to claim 15 wherein the second enlarged portion has a substantially planar surface for contacting the lever, and the lever has a rounded surface for contacting the planar surface of the second enlarged portion.

17. The humidifier according to claim 14 wherein the engaging member is pivotably connected to a wall disposed in or forming the secondary reservoir.

* * * * *